US008402875B2

(12) United States Patent
DeGreef

(10) Patent No.: US 8,402,875 B2
(45) Date of Patent: Mar. 26, 2013

(54) ARMOR PLATED DEVICE

(75) Inventor: Roger DeGreef, Washington Township, MI (US)

(73) Assignees: Roger Degreef, Washington Township, MI (US); David Robinson, Warren, MI (US)

( * ) Notice: Subject to any disclaimer, the term of this patent is extended or adjusted under 35 U.S.C. 154(b) by 1259 days.

(21) Appl. No.: 11/858,003

(22) Filed: Sep. 19, 2007

(65) Prior Publication Data

US 2012/0174743 A1 Jul. 12, 2012

(51) Int. Cl.
*F41H 3/00* (2006.01)

(52) U.S. Cl. ..... 89/36.01; 89/36.04; 405/284; 405/107

(58) Field of Classification Search ..... 89/36.01, 89/36.02, 36.04; 211/85.2, 59.1; 266/566; 405/31, 107, 114, 115, 116, 117, 284; 383/119; 220/9.1, 9.4, 23.91
See application file for complete search history.

(56) References Cited

U.S. PATENT DOCUMENTS

| | | | | |
|---|---|---|---|---|
| 1,296,421 | A * | 3/1919 | Miller et al. | 206/349 |
| 1,706,387 | A | 3/1929 | Kramer | |
| 1,777,926 | A | 10/1930 | Lillard | |
| 3,172,267 | A | 3/1965 | Fisher | |
| 3,228,361 | A | 1/1966 | Ritter | |
| 3,374,635 | A | 3/1968 | Crandall | |
| 3,545,155 | A | 12/1970 | Church, Jr. | |
| 3,784,085 | A | 1/1974 | Kilgore | |
| 3,820,294 | A | 6/1974 | Parker | |

(Continued)

FOREIGN PATENT DOCUMENTS

| | | |
|---|---|---|
| WO | 9804781 | 2/1998 |
| WO | 9942667 | 8/1999 |

(Continued)

OTHER PUBLICATIONS

Publication entitled "Multiple Challenges . . . One Versatile Solution" reprinted from: Geocell Systems Inc., Suite 202, Pier 54, Terry Francois Blvd., San Francisco, CA 94107 (info@geocellsystems.com); published in Dec. 14, 2002; by Geocell Systems Inc.

(Continued)

*Primary Examiner* — Daniel J Troy
(74) *Attorney, Agent, or Firm* — Howard & Howard Attorneys PLLC

(57) ABSTRACT

An armor plated assembly (20) and a protective wall system (120) containing a protective material. The armor plated assembly (20) comprises of a container (22) having opposing walls (26) for encompassing the protective material. The assembly (20) includes an armor device (24) having a first plate (48) and a second plate (50) with one of the opposing walls (26) sandwiched between the first plate (48) and the second plate (50) securing the armor device (24) to the container (22). The armor device (24) impedes the penetration of a projectile through the armor plated assembly (20). The protective wall system (120) includes at least two of the armor plated assemblies (20) with a mechanical connection (140) between the armor devices (126, 134) of the armor plated assemblies (20) for aligning and securing the assemblies (20) in a stacked orientation. A second embodiment of the protective wall system (220) includes at least two containers (222, 234) and a bib (232, 236) adhered to each of the containers (222, 234) such that the bibs (232, 236) overlap in a shingle-like engagement between the stacked containers (222, 234).

14 Claims, 10 Drawing Sheets

U.S. PATENT DOCUMENTS

| | | | | | |
|---|---|---|---|---|---|
| 3,856,268 | A | * | 12/1974 | Fitch | 256/13.1 |
| 3,886,751 | A | | 6/1975 | Labora | |
| 3,890,802 | A | | 6/1975 | Auriat et al. | |
| 3,922,832 | A | | 12/1975 | Dicker | |
| 4,294,405 | A | | 10/1981 | Ross | |
| 4,362,433 | A | | 12/1982 | Wagner et al. | |
| 4,423,854 | A | * | 1/1984 | Cobb et al. | 256/13.1 |
| 4,449,847 | A | | 5/1984 | Scales | |
| 4,545,286 | A | | 10/1985 | Fedij | |
| 4,578,814 | A | * | 3/1986 | Skamser | 383/99 |
| 4,650,368 | A | | 3/1987 | Bayer | |
| 4,723,742 | A | | 2/1988 | Krauss | |
| 4,784,520 | A | | 11/1988 | Stevens | |
| 4,963,037 | A | | 10/1990 | Manerba | |
| 5,031,733 | A | | 7/1991 | Chang | |
| 5,086,888 | A | | 2/1992 | Chu | |
| 5,149,203 | A | * | 9/1992 | Sacks | 383/111 |
| 5,241,783 | A | | 9/1993 | Krueger | |
| 5,584,599 | A | | 12/1996 | Knittel | |
| 5,605,232 | A | * | 2/1997 | Bickle | 206/764 |
| D382,349 | S | | 8/1997 | Hinton | |
| 5,669,732 | A | | 9/1997 | Truitt | |
| 5,678,358 | A | | 10/1997 | Koledin | |
| D393,322 | S | | 4/1998 | Suttles | |
| 5,792,974 | A | * | 8/1998 | Daqis et al. | 89/36.02 |
| 5,797,140 | A | | 8/1998 | Davis et al. | |
| 5,829,653 | A | * | 11/1998 | Kaiser | 224/577 |
| 5,829,915 | A | * | 11/1998 | Andreassen | 405/18 |
| 5,934,027 | A | | 8/1999 | Khalili | |
| 5,957,172 | A | | 9/1999 | DeGreef et al. | |
| 6,012,872 | A | | 1/2000 | Perry et al. | |
| 6,161,738 | A | * | 12/2000 | Norris | 224/153 |
| 6,390,154 | B1 | | 5/2002 | Hall | |
| 6,419,132 | B1 | * | 7/2002 | Reed et al. | 224/153 |
| 6,428,240 | B1 | | 8/2002 | Ehrlich et al. | |
| 6,477,934 | B1 | | 11/2002 | Bruhn et al. | |
| 6,491,431 | B2 | | 12/2002 | Merten | |
| 6,524,670 | B1 | | 2/2003 | Kataoka | |
| 6,612,741 | B1 | | 9/2003 | Horne | |
| 6,619,884 | B2 | | 9/2003 | Davis et al. | |
| 6,681,400 | B1 | | 1/2004 | Mills | |
| 6,685,071 | B2 | | 2/2004 | Prather | |
| 6,817,806 | B1 | | 11/2004 | Arellanes | |
| 6,843,616 | B2 | | 1/2005 | Sychra | |
| 6,874,401 | B2 | | 4/2005 | Bishop et al. | |
| 7,765,744 | B2 | * | 8/2010 | Herron | 52/79.5 |
| 2002/0090265 | A1 | | 7/2002 | Merten | |
| 2002/0106245 | A1 | | 8/2002 | Ehrlich et al. | |
| 2002/0164210 | A1 | | 11/2002 | Davis et al. | |
| 2003/0035689 | A1 | | 2/2003 | Metz | |
| 2003/0145530 | A1 | | 8/2003 | James | |
| 2004/0047689 | A1 | | 3/2004 | Davis et al. | |
| 2004/0052583 | A1 | | 3/2004 | Davis et al. | |
| 2004/0091181 | A1 | | 5/2004 | James | |
| 2004/0096275 | A1 | | 5/2004 | Rorheim | |
| 2004/0200339 | A1 | | 10/2004 | Bishop et al. | |
| 2005/0005566 | A1 | | 1/2005 | Kim | |
| 2005/0011347 | A1 | | 1/2005 | Muller et al. | |
| 2005/0045504 | A1 | * | 3/2005 | Tan | 206/315.7 |
| 2005/0123221 | A1 | | 6/2005 | Wang | |
| 2005/0169712 | A1 | | 8/2005 | Young | |
| 2008/0197756 | A1 | * | 8/2008 | Macias et al. | 312/3 |

FOREIGN PATENT DOCUMENTS

| | | |
|---|---|---|
| WO | 0233221 | 4/2002 |
| WO | 2005007598 | 1/2005 |
| WO | 2005047807 | 5/2005 |
| WO | 2005100903 | 10/2005 |

OTHER PUBLICATIONS

Publication entitled "Introducing the Rapid Deployment Flood Wall" reprinted from: Geocell Systems Inc., (http://www.geocell-systems.com/rdfw/index.htm); published in Jul. 15, 2005; by Geocell Systems Inc.

Publication entitled "FPED V . . . We Had a Blast" reprinted from: Geocell Systems Inc., (http://www.geocell-systems.com/security/RPED_5/; published in Apr. 29, 2005; by Geocell Systems Inc.

Publication entitled "RDFW Survives 40 Pounds of C-4 . . . TWICE!" reprinted from: Geocell Systems Inc., http://www.geocell-systems.com/security/Bakersfield/; published in Nov. 7, 2005; by Geocell Systems, Inc.

Publication entitled "Modular Versatile Force Protection" reprinted from: Geocell Systems Inc., Pier 54, Terry Francois Blvd., Suite 202, San Francisco, CA 94107 (info@geocellsystems.com; published in Aug. 12, 2003; by Geocell Systems Inc.

Publication entitled Joint Expeditionary Field Fortification: reprinted from: Marine Corps Warfighting Laboratory, Public Affairs Office, 3255 Meyers avenue, Quantico, VA 22134; (www.mcwl.quantico.usmc.mil); published in Jun. 2005; by Quantico USMC.

Publication entitled "USAF Builds RDFW Walls in Iraq" reprinted from: Geocell Systems Inc. (http://www.geocell-systems.com/security/Iraq_USAF_1/); published in Aug. 3, 2005; by Geocell systems Inc.

Publication entitled "Force Protection Application for the Rapid Deployment Foritfication Wall" reprinted from: Geocell Systems, Inc., Suite 202, Pier 54, Terry Francois Blvd., San Francisco, CA 94107 (info@geocellsystems.com) (GSA #GS-07F-0340M), published in Jul. 2002; by Geocell Systems Inc.

Publication entitled "Titanium Armor Plating for Armored Vehicles" reprinted from: ATI Wah Chang Allegheny Technologies (http://www.army-technology.com/company_printable.asp?ProductSubG...); by ATI Wah Chang Allegheny Technologies; accessed Oct. 15, 2007.

Publication entitled "RDFW Bagging Sandbags" reprinted from: Eastman Innovation Lab (http://www.innovationlab.eastman.com/InnovationLab/inspiration/Inspir...); by Eastman Innovation Lab; accessed Feb. 20, 2006.

* cited by examiner

ARMOR PLATED DEVICE

BACKGROUND OF THE INVENTION

1. Field of the Invention

An armor plated assembly for holding a protective material for impeding the penetration of a projectile.

2. Description of the Prior Art

A plurality of sandbags are often used to erect a wall for protection of personnel, i.e., people, and property. For example, the sandbags are often stacked to erect the wall, such as a dam or a dike, during a flood. The wall diverts water, thereby protecting people and property during the flood. The sandbags are also often used to deflect and absorb projectiles, e.g., bullets and shrapnel. For example, the sandbags are often used to erect fortifications, such as bunkers, to protect military personnel from bullets, explosions, and weather conditions. In addition, the sandbags are also used to protect vehicles, such as tanks and personnel carriers.

As known to those skilled in the art, the sandbags are typically filled with sand and are sealed to retain the sand therein. The sandbag is usually formed from burlap or a similar flexible material. However, the sandbags are prone to weathering, such as dry-rot, when exposed to UV rays, i.e., the sun, and water. In addition, the sandbags also rip and tear easily, especially when projectiles contact and pierce the sandbags and during movement and placement of the sandbags. When the sandbags are ripped or torn, the sandbags break down and quickly lose their effectiveness in stopping or slowing projectiles. This often occurs when the sandbags are pierced and sand leaks from the sandbags. In addition, the sandbags rely upon sand to absorb a majority of the force exerted by projectiles because the sandbags themselves are easily penetrated due to the material the sandbags are formed from.

Accordingly, there remains an opportunity to provide a sandbag with increased strength for protection of personnel and property. In addition, there remains an opportunity to provide a sandbag with increased locating, placing and fixing flexibility, such as when erecting a wall with a plurality of the sandbags.

SUMMARY OF THE INVENTION AND ADVANTAGES

An armor plated assembly containing a protective material. The armor plated assembly comprises of a container having opposing walls defining an envelope. A portion of the envelope is movable between an open position for receiving the protective material and a closed position for encompassing the protective material. The armor plated assembly includes an armor device at least partially disposed within the container. The armor device includes a first plate and a second plate with at least one of the opposing walls being sandwiched between the first plate and the second plate for securing the armor device to the container. The armor device impedes the penetration of a projectile through the armor plated assembly.

In another aspect the subject invention also provides for a protective wall system for protecting against the penetration of the projectile. The protective wall system includes a plurality of the above described armor plated assemblies. The protective wall system includes a first container having a first armor device partially disposed on the first container. The protective wall system includes a second container and a second armor device partially disposed on the second container. The first armor device includes a first outer plate and a first inner plate. The second armor device includes a second outer plate and a second inner plate. A mechanical connection is disposed between the first and second outer plates. The mechanical connection aligns the first and second armor devices and the first and second containers to define the protective wall system.

In another aspect the subject invention also provides for an alternative protective wall system for protecting against the penetration of the projectile.

The alternative protective wall system comprises of a first container having a top, a bottom, two opposing side and a base. The first container defines an envelope with a portion of the envelope movable between an open position for receiving a protective material and a closed position for encompassing the protective material. A first bib is attached to the top of the first container and the first bib extends over one of the opposing sides of the first container. The alternative protective wall system includes a second container having a top, a bottom, two opposing side and a base. The second container defines an envelope with a portion of the envelope movable between an open position for receiving the protective material and a closed position for encompassing the protective material. A second bib is attached to the top of the second container and extends over one of the opposing sides of the second container. The first bib overlaps the second bib in a shingle-like engagement for impeding the penetration of a projectile through the protective wall system.

Accordingly, the subject invention addresses the durability concern of the prior art sandbags by providing an armor plate or a protective bib for impeding the penetration of a projectile through the containers, as well as providing for a mechanical connection to align the assemblies to erect a wall or a structure.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
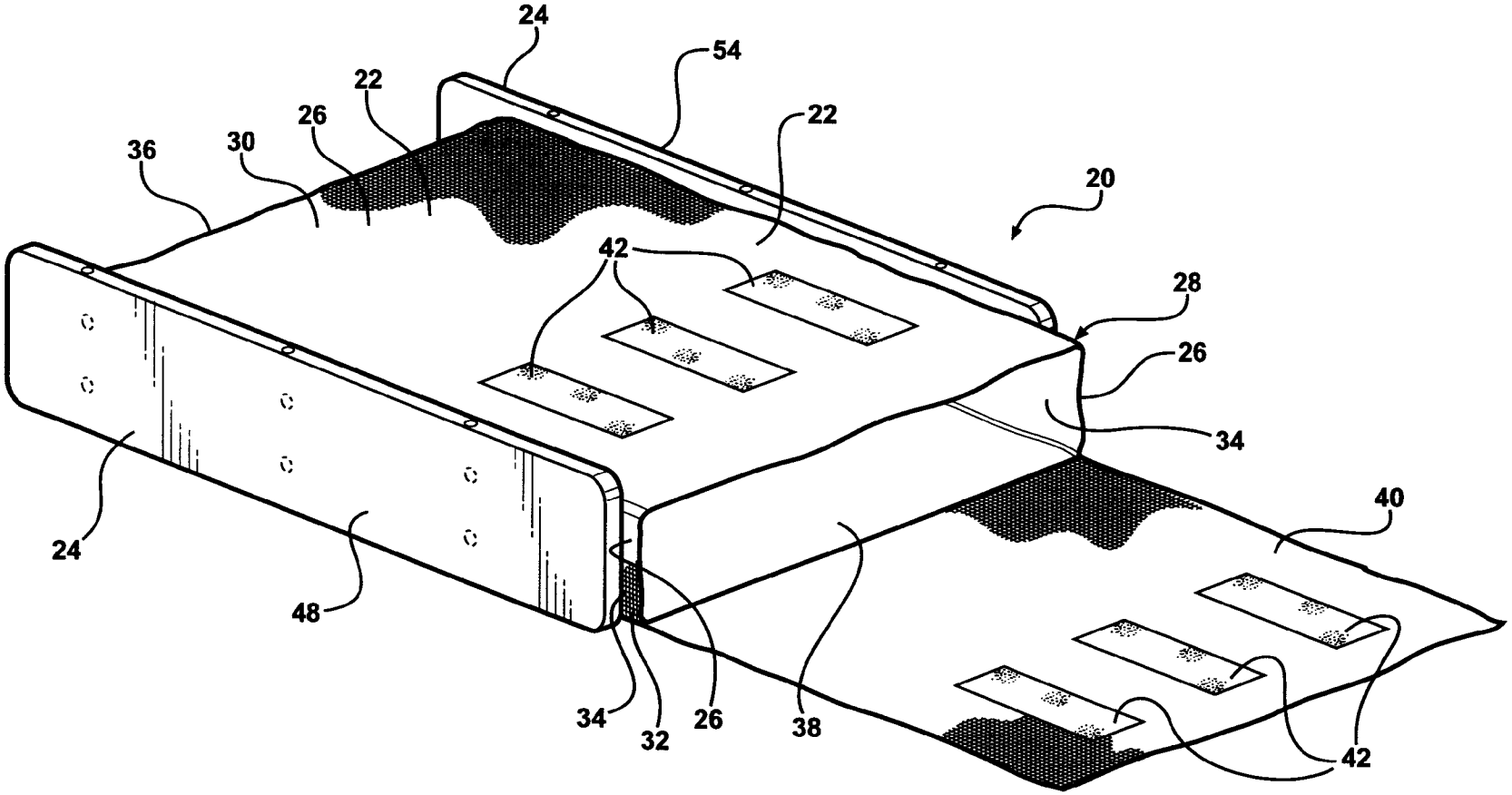
FIG. 1 is a perspective view of an armor plated assembly.

Referring to the Figures, wherein like numerals indicate corresponding parts throughout the several views, an armor plated assembly containing a protective material is shown at 20 in the Figures. The armor plated assembly 20 includes a container 22 and armor device 24 for stopping a projectile from penetrating into and through the armor plated assembly 20. The container 22 may be any suitable size and shape. As shown in FIGS. 1 through 4, the container 22 has opposing walls 26 that define an envelope 28. A portion of the envelope 28 is movable between an open position for receiving the protective material and a closed position for encompassing the protective material. In the illustrated embodiment the opposing walls 26 of the container 22 are defined as a top 30, a bottom 32 and two opposing sides 34. The two opposing side 34 are connected by the top 30 and the bottom 32.

Figure 2:
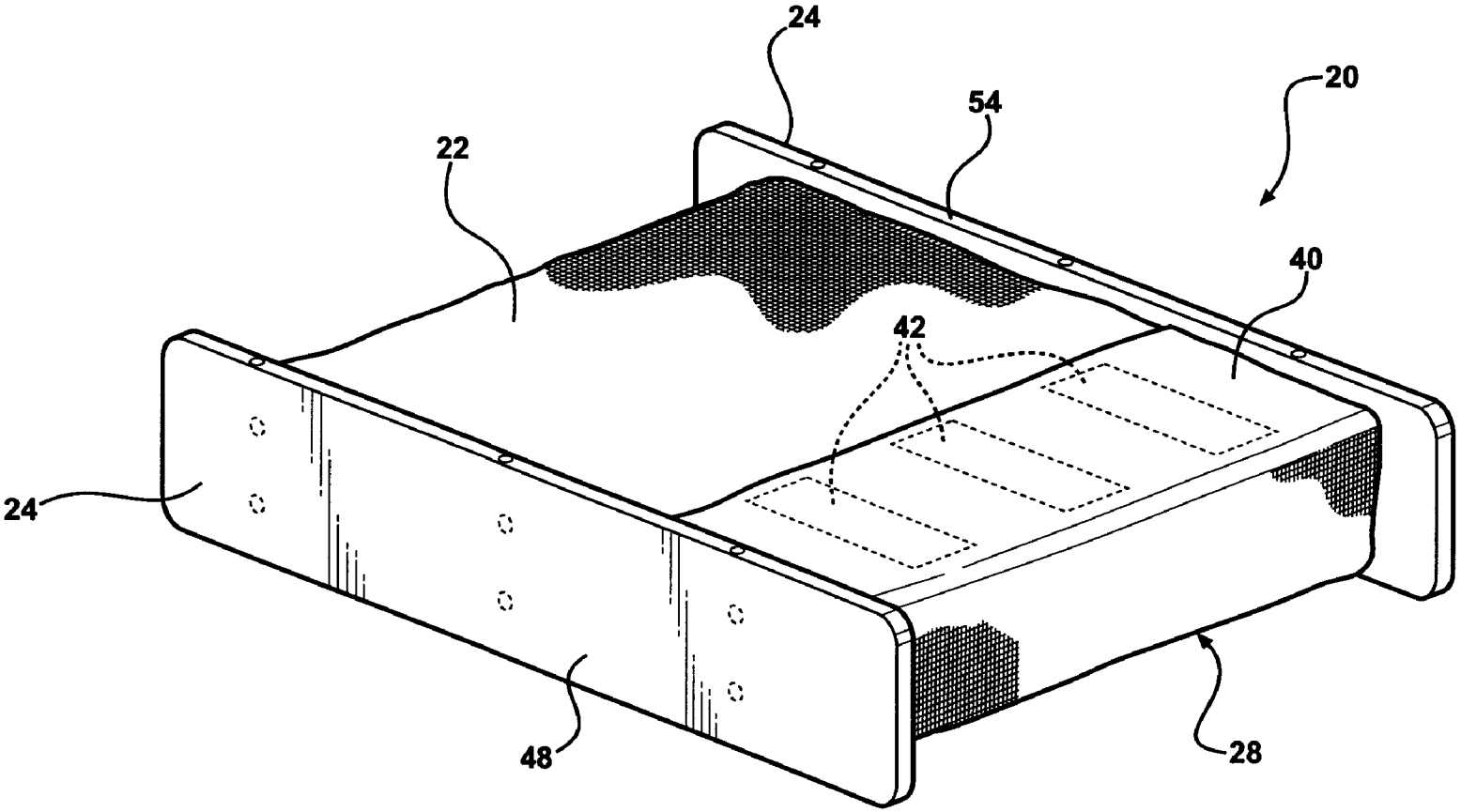
FIG. 2 is a perspective view of the armor plated assembly with a cover flap in a closed position for encompassing a protective material in the container.

The two opposing sides 34 each have a first and a second distal ends. A rounded base 36 at the first distal end extends between the top 30, bottom 32 and the two opposing sides 34 to form the envelope 28 or bag structure. The second distal end defines an opening 38 into the envelope 28 of the container 22. The container 22 also includes a cover flap 40 extending from either the top 30 or the bottom 32. A cover fastener 42 may be located on the cover flap 40 to engage either the top 30 or the bottom 32 to secure the cover flap 40 in a closed position for encompassing the protective material in the container 22, as shown in FIG. 2. The cover fastener 42 may be any suitable fastener known in the art and may include a hook and loop fastener, such as Velcro® manufactured by Velcro USA Inc. in Manchester, N.H., a zipper, a button, a string, a strap, an adhesive, a clasp, a plurality of stitches or a combination thereof. The container 22 may be formed from a suitable material as is known in the art. The material should be resistant to weather conditions, such as UV rays, water and optionally projectiles. For example, the material may be selected from the group of canvases, synthetic fibers, burlaps, textiles, fabrics, composites, polymers, combinations thereof, or other suitable materials as are known to those skilled in the art.

Figure 3:
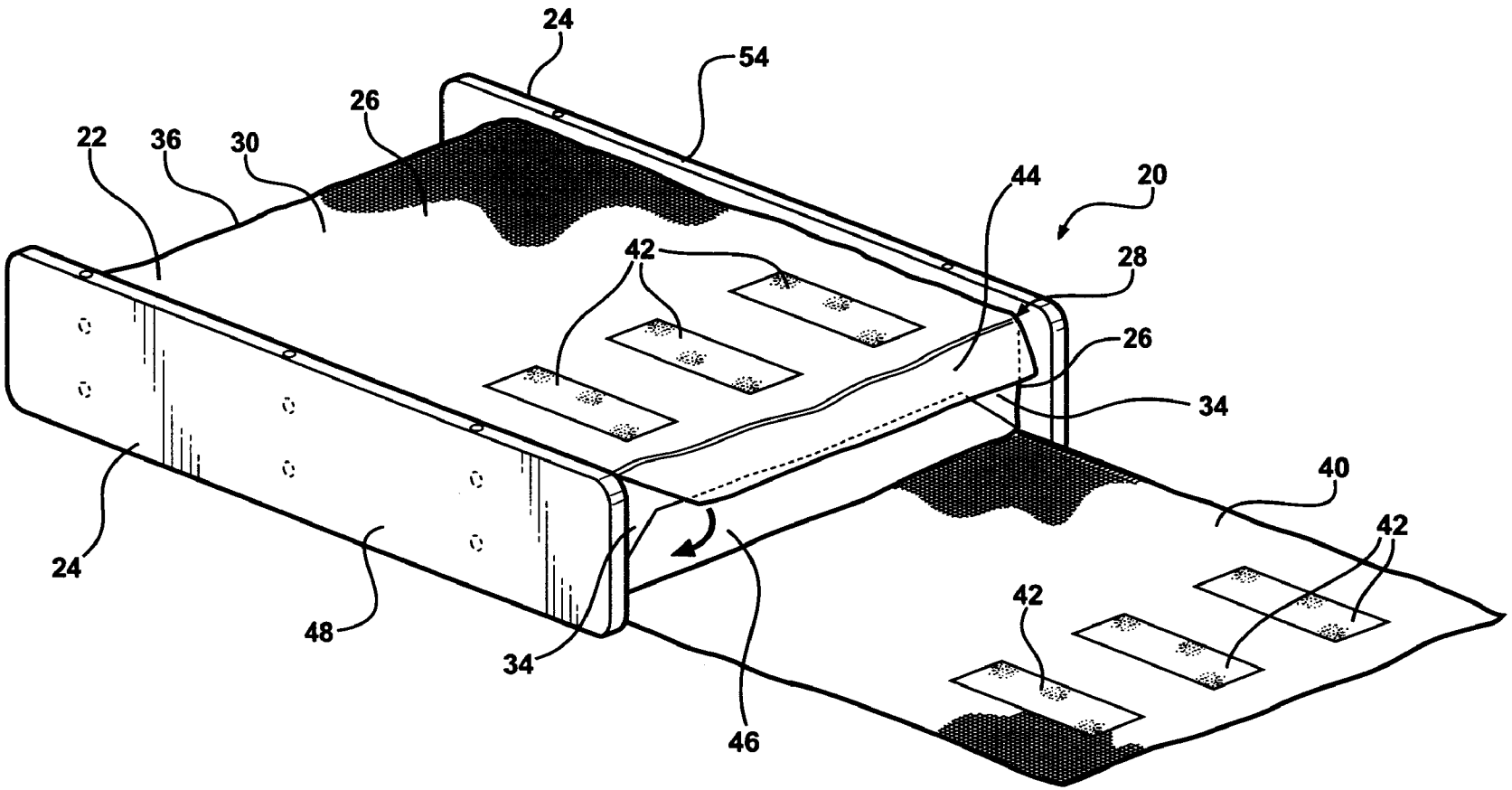
FIG. 3 is a perspective view of the armor plated assembly with additional inner flaps for folding over the opening of a container.

As shown in FIG. 3, the container 22 may additionally include a first inner flap 44 extending from the top 30 and a second inner flap 46 extending from the bottom 32. The inner flaps 44, 46 can be folded over the opening 38 to encompass the protective material in the container 22. The inner flaps 44, 46 are folded as indicated by the arrows in FIG. 3, with the first inner flap 44 being folded first from the opposing sides 34 inward into a trapezoidal shape and secondly folded over the opening 38. The second inner flap 46 is first folded inward from the two sides 34 into a trapezoidal shape and secondly folded over the first flap 44 and the opening 38 as indicated by the arrows closing off the opening 38 of the container 22. The protective material may include any suitable material known in the art. The protective material should be capable of stopping, absorbing, or slowing a projectile, e.g., a bullet, upon impact or entry. Typically, the protective material is filled into the container 22 as a loose bulk or free flowing material, e.g., sand or dirt. The inner flaps 44, 46 are folded over the opening 38 of the container 22 for providing additional protection against leakage of the protective material from the container 22. Since the effectiveness of the armor plated assembly 20 to impede the projectile may be significantly reduced if the protective material leaks from the container 22. The protective material may also be a pre-filled insert, such as a preformed or filled sandbag. The pre-filled insert may include an additional flexible container made of a plastic or similar material as the container 22.

The armor plated assembly 20 includes an armor device 24 at least partially disposed within the container 22. The armor device 24 has a first plate 48 and a second plate 50 with one of the opposing walls 26 sandwiched between the first plate 48 and the second plate 50 for securing the armor device 24 to the container 22. The first and second plates 48, 50 are for additional protection to impede the penetration of a projectile through the armor plated assembly 20. The first plate 48 is attached to the outside of the container 22 on one of the opposing walls 26. The second plate 50 is attached to the container 22 completely encompassed by and inside the container 22. The second plate 50 is aligned on the inside of the container 22 with the first plate 48 on the outside of the container 22 and the opposing wall 26 is between the first and second plates 48, 50 as previously discussed.

Figure 4:
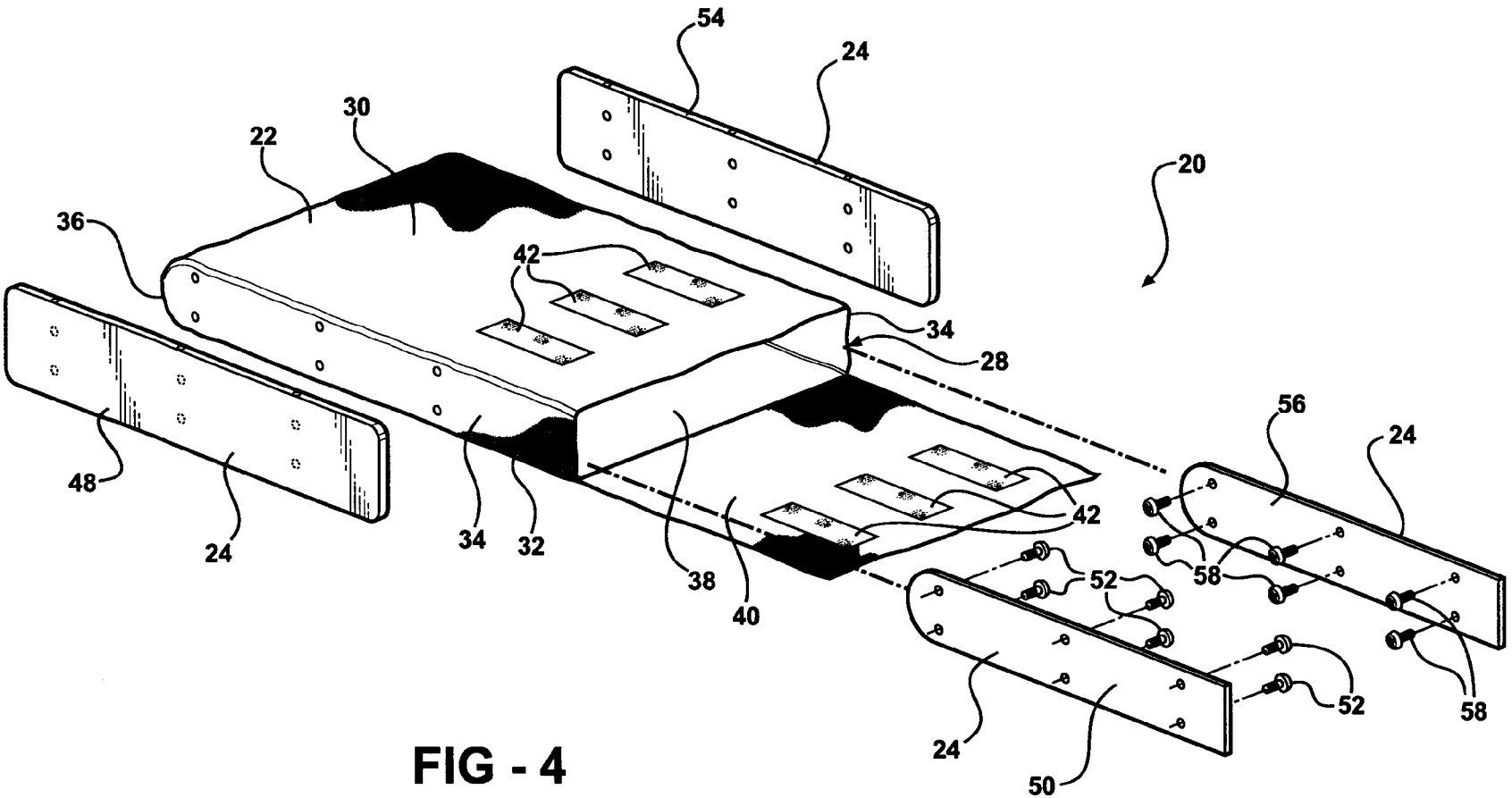
FIG. 4 is an exploded view of the armor plated assembly.
Figure 5:
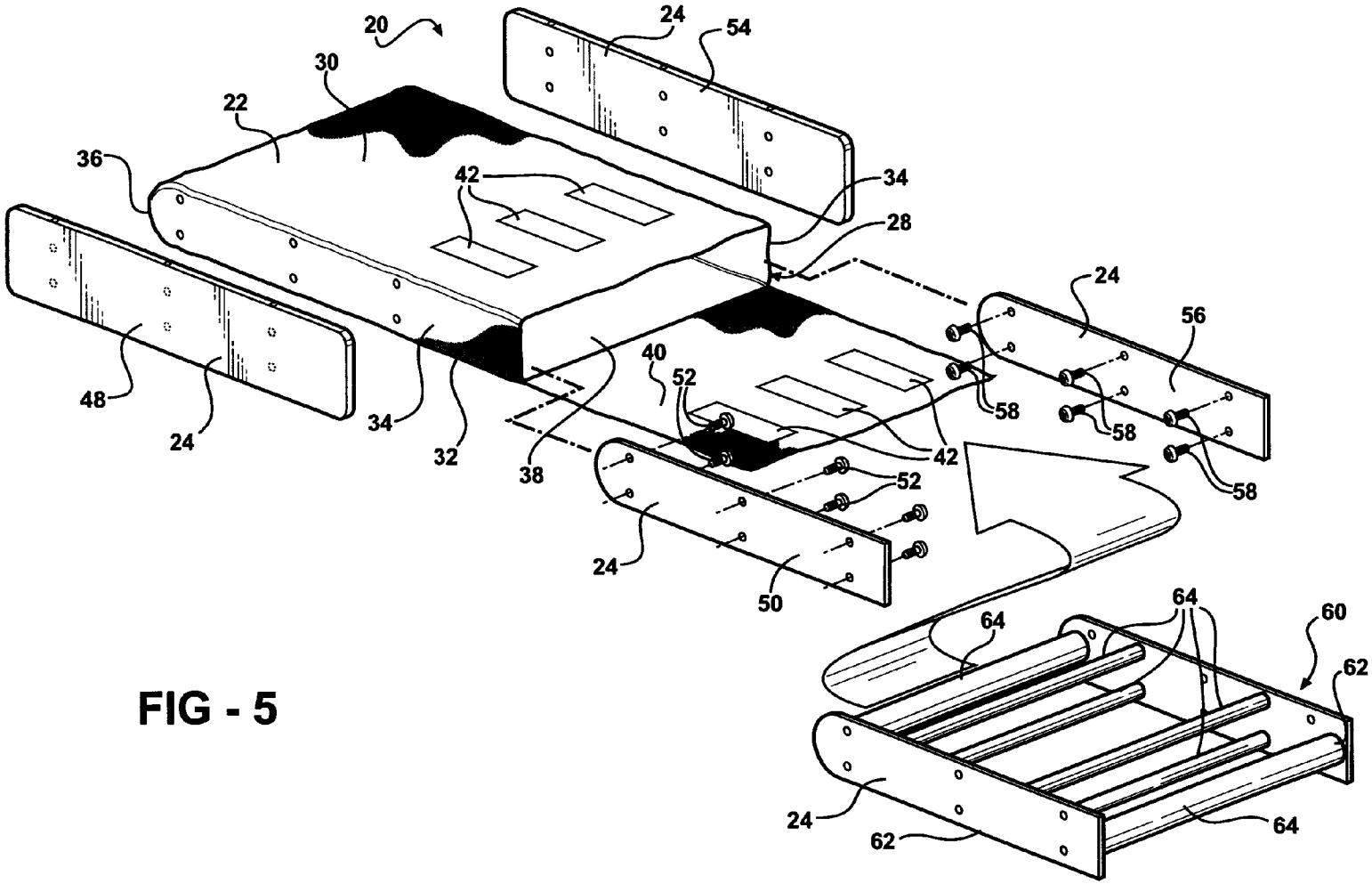
FIG. 5 is an exploded view of the armor plated assembly including an insert apparatus.

The armor device 24 may include at least one first fastener 52 coupled to the first plate 48, the opposing wall 26 and the second plate 50 for securing the first and second plates 48,50 about the opposing wall 26 of the container 22. The first fastener 52 may be selected from the group of rivets, screws, bolts and nuts, combinations thereof, or other fasteners known to those skilled in the art. As shown in FIGS. 4 and 5, the first fastener 52 extents through the second plate 50, the opposing wall 26 and into the first plate 48. The first fastener 52 does not extend through the first plate 48; however, it is appreciated that a nut and bolt or other alternatives known to those skilled in the art may require the first fastener 52 to extend through the first plate 48. It should also be appreciated that the plates 48, 50 may also, or alternatively, be connected by any method or process known in the art. For example, the plates 48, 50 may be pressed, stamped, welded, or adhered, e.g., glued, together.

The armor plated assembly 20 includes scalable protection levels adaptable to protect against various projectiles as required for each given application or environment. The armor device 24 in the illustrated embodiment further includes a third plate 54 and a fourth plate 56. The third and fourth plates 54, 56 are secured to the container 22 with another of the opposing walls 26 sandwiched between the third plate 54 and the fourth plate 56. The additional plates 54, 56 provide additional protection against the penetration of the projectile through the armor plated assembly 20. The third plate 54 is attached to the outside of the container 22 on one of the opposing walls 26. The fourth plate 56 is attached to the container 22 completely encompassed by and inside the container 22. The fourth plate 56 is aligned on the inside of the container 22 with the third plate 54 on the outside of the container 22 and the opposing wall 26 is between the third and fourth plates 54, 56 as previously discussed.

The armor device 24 may include at least one second fastener 58 coupled to the third plate 54, the other opposing wall 26 and the fourth plate 56 for securing the third and fourth plates 54, 56 about the opposing wall 26. The second fastener 58 may be selected from the group of rivets, screws, bolts and nuts, combinations thereof, or other fasteners known to those skilled in the art. As shown in FIGS. 4 and 5, the second fastener 58 extents through the fourth plate 56, the opposing wall 26 and into the third plate 54. The second fastener 58 does not extend through the third plate 54; however, it is appreciated that a nut and bolt or other alternatives known to those skilled in the art may require the second fastener 58 to extend through the third plate 54. It should also be appreciated that the plates 54, 56 may also, or alternatively, be connected by any method or process known in the art. For example, the plates 54, 56 may be pressed, stamped, welded, or adhered, e.g., glued, together.

The plates 48, 50, 54, 56 may be formed from a suitable material as is known in the art. The material should be capable of stopping, absorbing, or slowing a projectile, e.g., a bullet, upon impact. For example, the material may be selected from the group of metals, alloys, plastics, polymers, ceramics, composites, combinations thereof, or other suitable materials as are known to those skilled in the art. As another example, the plates 48, 50, 54, 56 may be formed from titanium or titanium alloys, such as Ti-6a1-4v, Ti-6a1-4v ELI, any material meeting the military specification in class 4-mil-dt1-46077 or equivalent materials or combinations thereof. In one embodiment, each one of the plates 48, 50, 54, 56 is formed from the same material, respectively. However, it is appreciated that each plate 48, 50, 54, 56 may be formed of a different material. It should also be appreciated that any combination of materials may be selected for each one of the plates 48, 50, 54, 56 respectively. In addition to providing for material options to provide scalable degrees of protection the thickness of the plates may also vary to accommodate the protection needed for each application.

Optionally, the armor device 24 may include an insert apparatus 60. The insert apparatus 60 is removably disposed within the envelope 28 of the container 22 as shown in FIG. 5. The insert apparatus 60 provides support to the container 22 and spaces the opposing walls 26. The insert apparatus 60 allows for the armor plated assembly 20 to be used in environments or applications where filling the containers 22 with a protective material such as sand or dirt is not preferred. The insert apparatus 60 includes a pair of outer supports 62 spaced a distance apart and supported by at least one rod 64 extending generally perpendicular between the outer supports 62. The outer supports 62 are in contact with the second and fourth plates 50, 56 to support the container 22. In the illustrated embodiment the insert apparatus 60 includes six rods 64 extending between the outer supports 62 to provide additional protection as well as giving the armor plated assembly 20 additional weight to mimic that of the protective material against projectiles.

Figure 6:
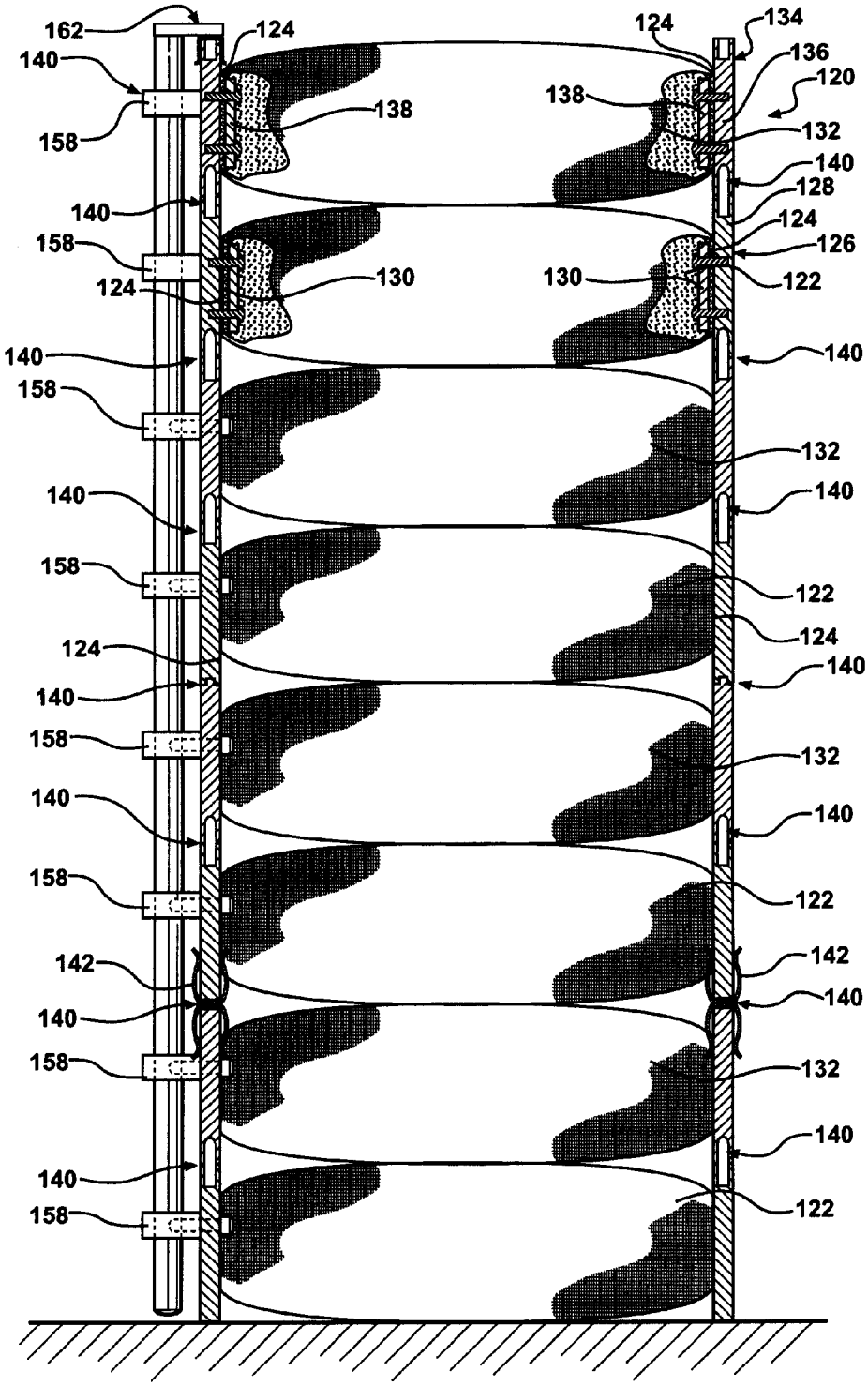
FIG. 6 is a cross-sectional view of a protective wall system including a mechanical connection for aligning and securing the containers in a stacked orientation.
Figure 7A:
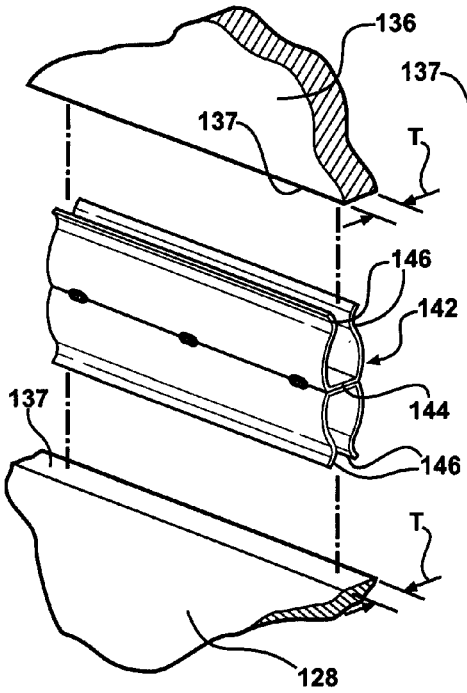
FIG. 7A is a detailed view of a first embodiment of a mechanical connection.
Figure 7B:
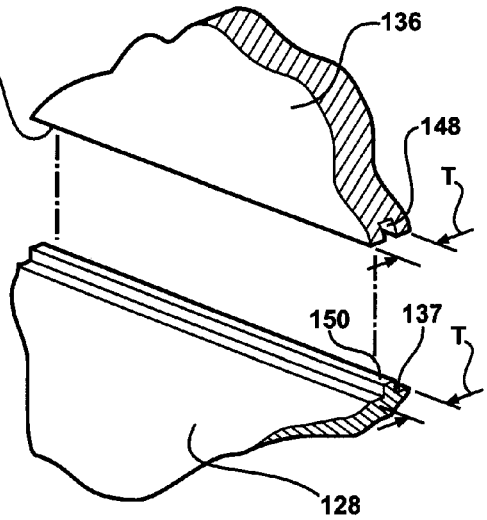
FIG. 7B is a detailed view of a second embodiment of the mechanical connection.
Figure 7C:
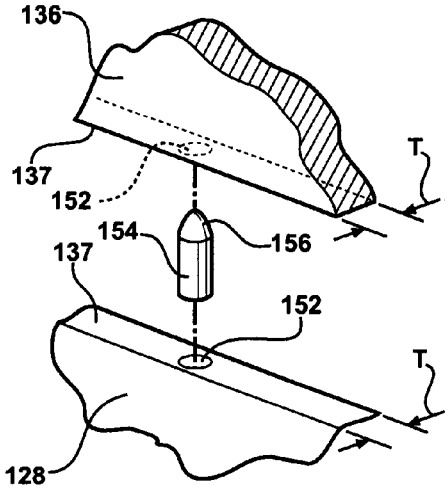
FIG. 7C is a detailed view of a third embodiment of the mechanical connection.
Figure 7D:
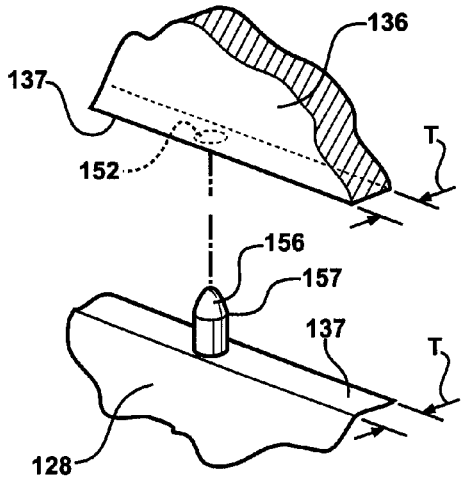
FIG. 7D is a detailed view of a fourth embodiment of the mechanical connection.
Figure 8:
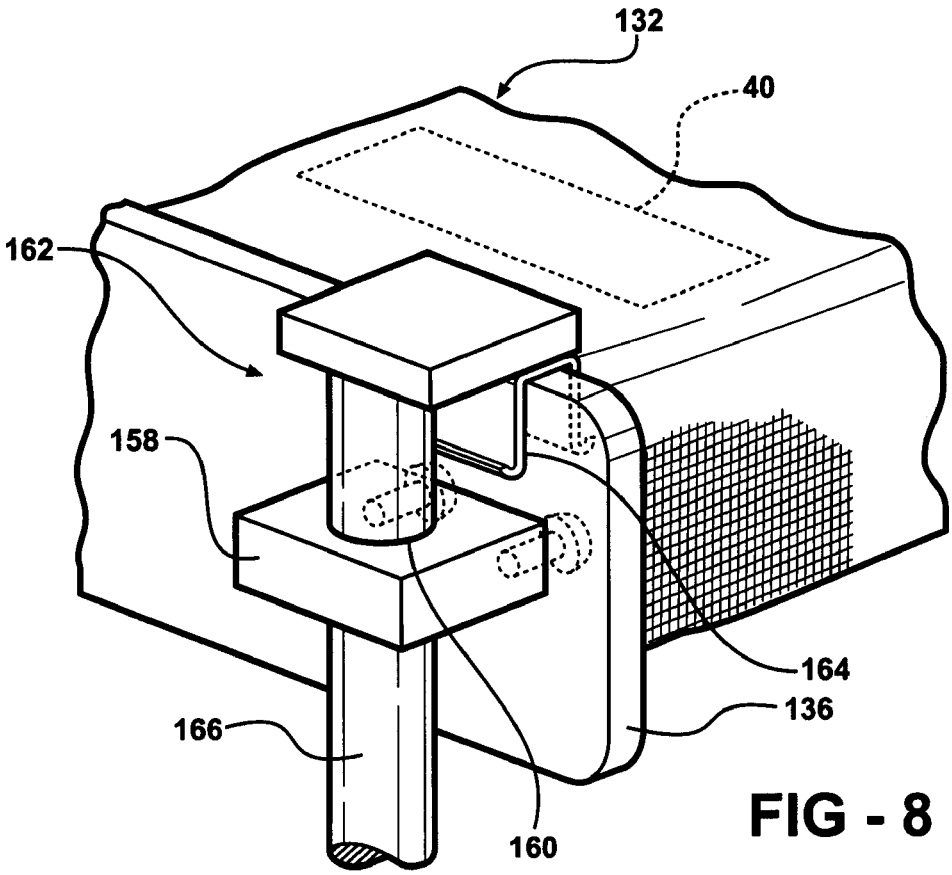
FIG. 8 is a detailed view of a retention apparatus engaging a first plate of the container.
Figure 9:
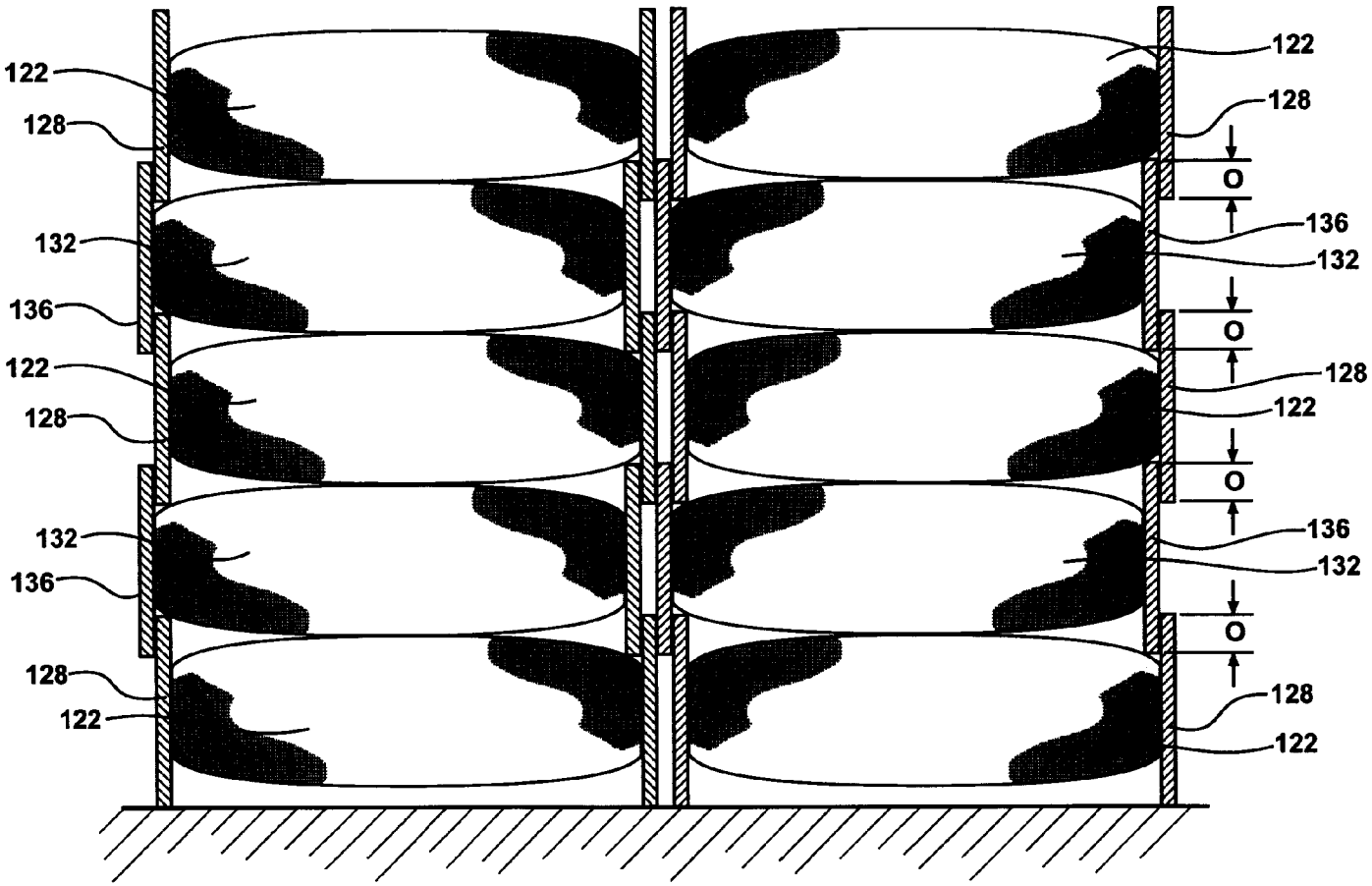
FIG. 9 is a side view of an alternative stacking arrangement of the protective wall assembly.

Referring to FIGS. 6 through 8, the subject invention also includes a protective wall system 120 for protecting against the penetration of a projectile. The protective wall system 120 comprises of a series of the armor plated assemblies 20 stacked in a formation of a wall or structure. The protective wall system 120 incorporates the structure of the above assembly 20 but further includes a mechanical connection to secure a plurality of the above discussed assemblies 20 in a stack orientation or aligned orientation. For simplification, to clearly understand the protective wall system 120 the numbering is starting from 120 in this section. In addition, the description of the protective wall system 120 includes only two assemblies or containers 122, 132 but, as shown in FIGS. 6 and 9, the protective wall system 120 may further include additional assemblies 20 to build a wall of the desired height or desired structure.

The protective wall system 120 includes a first container 122 having opposing walls 124 defining an envelope. The first container 122 is similar to the container 22 previously discussed. As previously discussed, a portion of the envelope is movable between an open position for receiving a protective material and a closed position for encompassing the protective material. A first armor device 126 is at least partially disposed within the first container 122. The first armor device 126 has a first outer plate 128 and a first inner plate 130 with at least one of the opposing walls 124 of the first container 122 being sandwiched between the first outer plate 128 and the first inner plate 130. The first outer and first inner plates 128, 130 provide protection for impeding the penetration of a projectile through the first container 122. It should be appreciated that the first outer plate 128 is equivalent and similar to the first plate 48 and the first inner plate 130 is equivalent and similar to the second plate 50. In additional the protective wall system may include an additional first outer plate 128 equivalent and similar to the third plate 54 and an additional first inner plate 130 equivalent and similar to the fourth plate 56, as shown in FIG. 6. The additional plates 128, 130 are shown in the illustrate embodiment but it should be appreciated by one skilled in the art that the additional plates 128, 130 are added depending on the degree of protection needed for impeding the projectile through the protective wall system 120 for a given application or environment.

The protective wall system 120 further includes a second container 132 having opposing walls 124 defining an envelope. The second container 132 is again similar to the container 22 previously discussed. As previously discussed, a portion of the envelope is movable between an open position for receiving a protective material and a closed position for encompassing the protective material. A second armor device 134 is at least partially disposed within the second container 132. The second armor device 134 has a second outer plate 136 and a second inner plate 138 with one of the opposing walls 124 of the second container 132 being sandwiched between the second inner plate 138 and the second outer plate 136. The second inner and the second outer plates 138, 136 provide protection for impeding the penetration of a projectile through the second container 132. It should be appreciated that the second outer plate 136 is equivalent and similar to the first plate 48 and the second inner plate 138 is equivalent and similar to the second plate 50. In additional the protective wall system may include an additional second outer plate 136 equivalent and similar to the third plate 54 and an additional second inner plate 138 equivalent and similar to the fourth plate 56, as shown in FIG. 6. The additional plates 136, 138 are shown in the illustrate embodiment but it should be appreciated by one skilled in the art that the additional plates 136, 138 are added depending on the degree of protection needed for impeding the projectile through the protective wall system 120 for a given application or environment.

The first and second outer plates 128, 136 define a peripheral edge 137 having a thickness, T. The thickness of the outer plates 128, 136 may vary to provide varying protection scalable for each application and environment.

The protective wall system 120 includes a mechanical connection 140 defined between the first and second outer plates 128, 136 of the first and second armor devices 126, 134 respectively for aligning the first and second containers 122, 132 to build the protective wall system 120. There are several contemplations to allow for the joining of the first and second outer plates 128, 136 to create an interlock between the containers 122, 132, as shown in FIG. 6. The various mechanical connections 140 are shown in FIG. 6 and FIGS. 7A-7D, and one skilled in the art would recognize that there are nearly endless possibilities to join and align the containers 122, 132. As shown in FIG. 7A, a first embodiment of the mechanical connection 140 includes a clip 142 having a base 144 with two pairs of fingers 146 extending in opposite directions from the base 144. Each pair of fingers 146 is biased inward for engaging either the first or second outer plates 128, 136. The clip 142 secures the first and second containers 122, 132 with the base 144 of the clip 142 between the first and second outer plates 128, 136, as shown in the FIGS. 6 and 7A.

Referring now to FIGS. 6 and 7B, a second embodiment of the mechanical connection 140 includes a slot 148 formed in the peripheral edge 137 in both the first and second outer plates 128, 136 and a ridge 150 formed in both the peripheral edge 137 of the first and second outer plates 128, 136. The ridge 150 is spaced from the slot 148 on each of the first and second outer plates 128, 132 and in the illustrated embodiment the ridge 150 and slot 148 are on opposite sides of the first and second outer plates 128, 136. As shown in FIG. 7B, the ridge 150 of the first outer plate 128 engages into the slot 148 of the second outer plate 136 for aligning the first and second containers 122, 132 in a stacked orientation.

Referring to FIGS. 6 and 7C, a third embodiment of the mechanical connection 140 includes at least one hole 152 formed in the peripheral edge 137 of the first and second outer plates 128, 136 and a removable pin 154. As shown in FIG. 7C, the removable pin 154 is disposed into the hole 152 of the first outer plate 128 and a corresponding hole 152 of the second outer plate 136 for aligning and securing the first and second containers 122, 132 in a stacked orientation. The removable pin 154 includes a tapered tip 156 to aid in the alignment of the first and second outer plates 128, 136 during the stacking of the first and second containers 122, 132. In addition as shown in FIG. 7D, it is also contemplated that a post 157 may be fixed on the first and second outer plates 128, 136 and extending from the peripheral edge 137 into the corresponding hole 152 on the opposite side of the post 157 on the first and second outer plates 128, 136.

Referring to FIGS. 6 and 8 the mechanical connection may include at least one tab 158 connected to and extending outwardly from the first and second outer plates 128, 136. The tab 158 defines an aperture 160. The mechanical connection 140 further includes a retention apparatus 162. The retention apparatus 162 includes a C-shaped clasp 164 for saddling engagement with either the first outer plate 128 or the second outer plate 136. The retention apparatus 162 also includes a shaft 166 that connects with the C-shaped clasp 164 and extends parallel with the first and second outer plates 128, 136 through the aperture 160 of the tabs 158 for aligning the first and second containers 122, 132 in a stack orientation.

As shown in FIG. 9, the mechanical connection may also include the first and second outer plates 128, 136 with each of the outer plates 128, 136 defining an overlapping section O. The first and second outer plates 128, 136 are disposed in interleaving side-by-side engagement with the overlapping sections O engaging each other. Optionally, additional rows may be stacked to offer additional protection against the penetration of a projectile through the protective wall system.

Figure 10A:
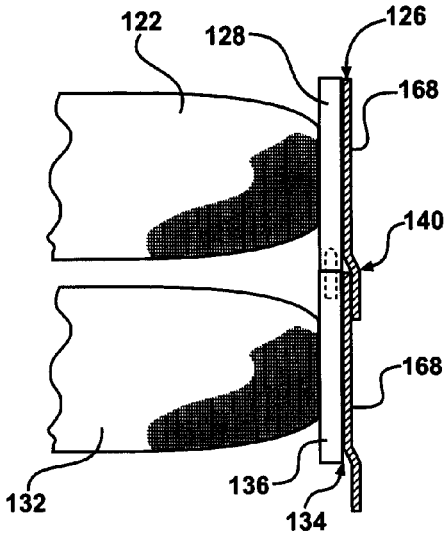
FIG. 10A is a detailed cross-sectional view of the protective wall system with an optional bib.
Figure 10B:
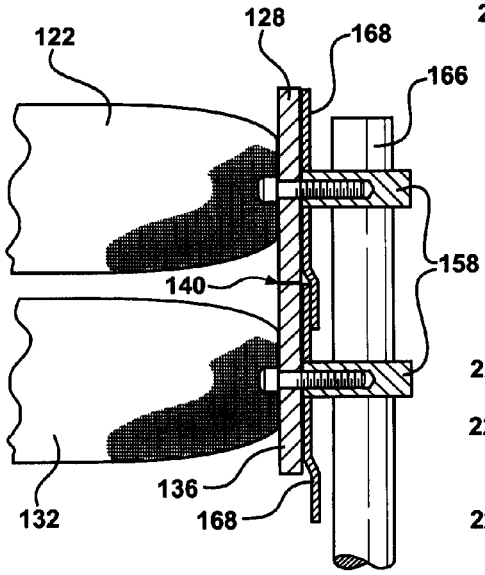
FIG. 10B is a second detailed cross-sectional view of the protective wall system with the optional bib.

As shown in FIGS. 10A and 10B, the first armor device 126 may include a bib 168 optionally adhered to the first outer plate 128. The second armor device 134 may include a bib 168 optionally adhered to the second outer plate 136. The bib 168 of the first armor device 126 extends past the first outer plate 128 on the second outer plate 136 and over the bib 168 of the second armor device 134 at the mechanical connection 140 between the first and second outer plates 128, 136. The bib 168 may be made of a synthetic fiber, an Interceptor® material, manufactured by Point Blank Body Armor Inc. in Pompano, Fla. or a Dragon Skin® material manufactured by Pinnacle Armor in Fresno, Calif. In addition, one skilled in the art would recognize that the bib 168 may be made of any material suitable to provide additional protection to impede the penetration of a projectile through the mechanical connection 140 of the protective wall system 120.

Figure 10C:
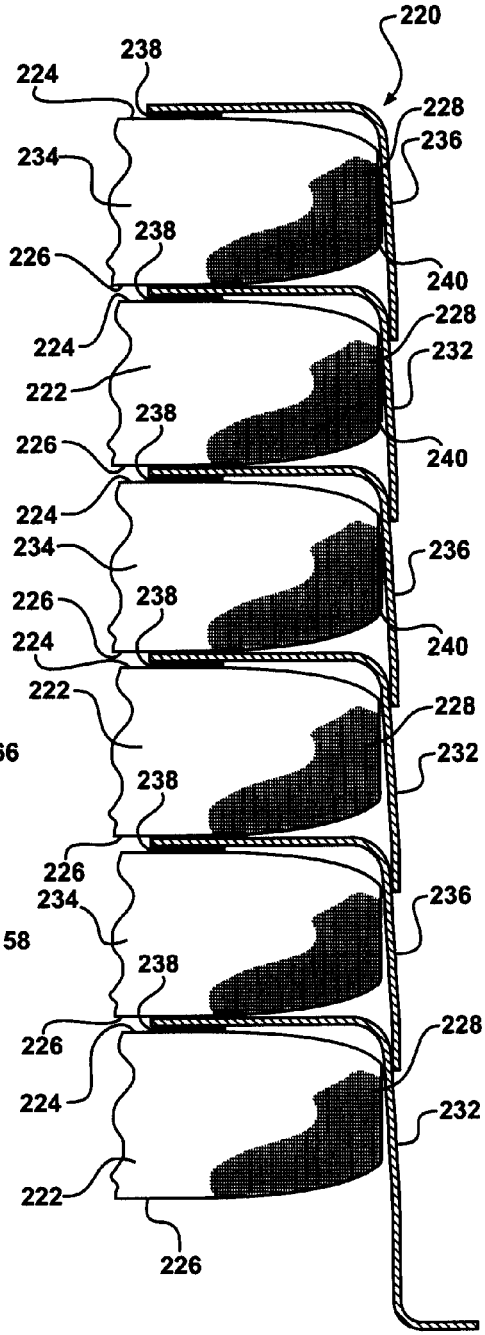
FIG. 10C is a partial side cross-sectional view of a second embodiment of the protective wall system.

As shown in FIG. 10C, is a second embodiment of the protective wall system 220. The second embodiment of the protective wall system 220 comprises of a first container 222 having a top 224, a bottom 226, two opposing side 228 and a base defining an envelope. A portion of the envelope is movable between an open position for receiving the material and a closed position for encompassing the material. A first bib 232 is attached to the top 224 of the first container 222 and extends over one of the opposing sides 228 of the first container 222. The protective wall system 220 includes a second container 234 having a top 224, a bottom 226, two opposing side 228 and a base defining an envelope. A portion of the envelope is movable between an open position for receiving a protective material and a closed position for encompassing the protective material. A second bib 236 is attached to the top of the second container 234 and extends over one of the opposing sides 228 of the second container 234. The first bib 232 overlaps the second bib 236 in a shingle-like engagement for impeding the penetration of a projectile through the armor plated assembly. The first and second bibs 232, 236 are attached to the containers 222, 234 in any suitable manner known to one skilled in the art. In the illustrated embodiment, the bibs 232, 236 are adhered to the containers 222, 234 by a bib fastener 238. The bib fastener 238 may include a two-side tape, a hook and loop fastener, such as Velcro® manufactured by Velcro USA Inc. in Manchester, N.H., or any suitable method as is known in the art. The bibs 232, 236 are made of a synthetic fiber, an Interceptor® material, manufactured by Point Blank Body Armor Inc. in Pompano, Fla. or a Dragon Skin® material manufactured by Pinnacle Armor in Fresno, Calif. It is understood by one skilled in the art that the bibs 232, 236 may be made of various materials that impede the penetration of a projectile into the container 222, 234. Optionally, the second embodiment may further include a second bib fastener 240 for securing the first and second bibs 232, 236 to one of the opposing sides 228 of the first and second containers 222, 234, respectively. The second bib fastener 240 may include a two-side tape, a hook and loop fastener, such as Velcro® manufactured by Velcro USA Inc. in Manchester, N.H., or any suitable method as is known in the art.

The second embodiment may be retrofitted onto an existing protective wall of sandbags or containers 222, 234. The bibs 232, 236 may be retrofitted to the existing protective wall by making the bibs 232, 236 in various geometries to accommodate the various sizes of sandbags or containers 222, 234. The bibs 232, 236 need to be sized to the sandbag or container such that the bibs 232, 236 maintain the shingle-like engagement as shown in FIG. 10C. The bibs 232, 236 may be attached to the existing sandbags or containers 222, 234 in any suitable manner used by one skilled in the art.

The invention has been described in an illustrative manner, and it is to be understood that the terminology which has been used is intended to be in the nature of words of description rather than of limitation. As is now apparent to those skilled in the art, many modifications and variations of the present invention are possible in light of the above teachings. It is, therefore, to be understood that within the scope of the appended claims the invention may be practiced otherwise than as specifically described.

What is claimed:

1. An armor plated assembly containing a protective material, said armor plated assembly comprising:

a container having opposing walls defining an envelope with a portion of said envelope movable between an open position for receiving the material and a closed position for encompassing the material; and an armor device at least partially disposed within said container with said armor device having a first plate disposed entirely outside of said container and a second plate disposed entirely within said walls of said container with one of said opposing walls being sandwiched between said first plate and said second plate for securing said armor device to said container and for impeding the penetration of a projectile into said container and through said armor plated assembly;

said first plate being elongated and dimensionally larger than said sandwiched wall to entirely cover said sandwiched wall for further impeding the penetration of a projectile into said container and through said armor plated assembly, wherein said first plate is configured to be stackably connected to one or more additional armor plated assemblies;

wherein said armor device further includes at least one first fastener extending through and coupled to said first plate, said wall and said second plate for securing said first and second plates to opposing surfaces of said sandwiched wall.

2. An assembly as set forth in claim 1 wherein said armor device further includes a third plate and a fourth plate with another of said opposing walls being sandwiched between said third plate and said fourth plate for providing additional protection against the penetration of the projectile through said armor plated assembly.

3. An assembly as set forth in claim 2 wherein said armor device further includes at least one second fastener extending through and coupled to said third plate, said other wall and said fourth plate for securing said third and fourth plates to opposite sides of said sandwiched other wall.

4. An assembly as set forth in claim 3 wherein said first, second, third and fourth plates are fabricated from at least one of a metal, an alloy, a plastic, a polymer, a ceramic, a composite, a titanium, a Ti-6a1-4v, Ti-6a1-4v ELI and a combination thereof.

5. An assembly as set forth in claim 4 wherein said container is made of at least one of a canvas, a synthetic fiber, a burlap, a textile, a fabric, a composite, a polymer and a combination thereof.

6. An assembly as set forth in claim 1 wherein said opposing walls of said container are further defined by a top and a bottom and two opposing sides with each of said two opposing sides having first and second distal ends and said two opposing sides being connected by said top and said bottom.

7. An assembly as set forth in claim 6 further including a rounded base extending between said top and said bottom and connected at said first distal end of said two opposing sides with said second distal end defining an opening into said envelope of said container.

8. An assembly as set forth in claim 7 further including a first inner flap extending from said top and a second inner flap extending from said bottom for folding said first and second inner flaps over said opening to encompass the material in said container.

9. An assembly as set forth in claim 8 further including a cover flap extending from one of said top and said bottom and a cover fastener on said cover flap for engaging the other of said top and said bottom.

10. An assembly as set forth in claim 9 wherein said cover fastener is further defined as at least one of a hook and loop fastener, a zipper, a button, a string, a strap, an adhesive, a clasp, a plurality of stitches and a combination thereof.

11. An assembly as set forth in claim 1 wherein said armor device further includes an insert apparatus removably disposed within said envelope of said container for supporting said container and spacing said opposing wall of said container.

12. An assembly as set forth in claim 11 wherein said insert apparatus includes a pair of outer supports spaced a distance apart and supported by at least one rod extending generally perpendicular between said outer supports with one of said outer supports abutting said second plate.

13. An armor plated assembly comprising:

a container having opposing walls defining an envelope with a portion of said envelope movable between an open position and a closed position;

a protective material including sand selectively disposed in said container; and an armor device at least partially disposed within said container with said armor device having a first plate disposed entirely outside of said container and a second plate disposed entirely inside of said container with one of said opposing walls being sandwiched between said first plate and said second plate for securing said armor device to said container and for impeding the penetration of a projectile into said container and through said armor plated assembly;

said first plate being elongated and dimensionally larger than said sandwiched wall to entirely cover said sandwiched wall for further impeding the penetration of a projectile into said container and through said armor plated assembly, wherein said first plate is configured to be stackably connected to one or more additional armor plated assemblies;

wherein said armor device further includes at least one first fastener extending through and coupled to said first plate, said wall and said second plate for securing said first and second plates to opposing surfaces of said sandwiched wall.

14. An assembly as set forth in claim 13 wherein said armor device further includes a third plate disposed outside of said container and a fourth plate disposed inside of said container with another of said opposing walls being sandwiched between said third plate and said fourth plate for providing additional protection against the penetration of the projectile through said armor plated assembly.

* * * * *